United States Patent [19]

Black

[11] 4,128,059

[45] Dec. 5, 1978

[54] COLOR-DISSEMINATING PROJECTILE FOR TRAINING CARTRIDGE

[75] Inventor: Walter L. Black, Baltimore County, Md.

[73] Assignee: The United States of America as represented by the Secretary of the Army, Washington, D.C.

[21] Appl. No.: 817,303

[22] Filed: Jul. 20, 1977

[51] Int. Cl.[2] ..... F42B 11/18

[52] U.S. Cl. ..... 102/92.7

[58] Field of Search ..... 102/92.7, 92.6, 41

[56] References Cited

U.S. PATENT DOCUMENTS

| | | | |
|---|---|---|---|
| 759,516 | 5/1904 | Guye | 102/92.7 |
| 3,156,187 | 11/1964 | Batou | 102/92.7 |
| 3,429,263 | 2/1969 | Snyder et al. | 102/92.7 |
| 3,528,662 | 9/1970 | Merchant et al. | 102/92.7 |
| 3,865,038 | 2/1975 | Barr | 102/92.7 |
| 3,911,824 | 10/1975 | Barr et al. | 102/92.7 |
| 3,983,817 | 10/1976 | Tucker | 102/41 |

*Primary Examiner*—Charles T. Jordan

*Attorney, Agent, or Firm*—Nathan Edelberg; Harold H. Card, Jr.; A. Victor Erkkila

[57] ABSTRACT

A training cartridge projectile comprises: a plastic housing having a prism-shaped axial recess of hexagonal cross-section, closed at the rear and open at the front; a heavy piston of similar shape slidable in the recess; a cup-shaped plastic ogive member having its open end attached to the open end of the housing to form a dye cavity and comprising an annular weakening groove; spring means between the ogive member and the piston; and a mass of aerosol-producing dye material in the dye cavity adapted to be disseminated by the forward motion of the piston in the projectile on impact with a target.

5 Claims, 2 Drawing Figures

COLOR-DISSEMINATING PROJECTILE FOR TRAINING CARTRIDGE

GOVERNMENT INTEREST

The invention described herein was made in the course of or under a contract or sub-contract thereunder with the United States Government.

BACKGROUND AND SUMMARY OF THE INVENTION

The present invention relates to improved training or practice cartridges, and particularly to an improved color-disseminating projectile for such cartridges.

A need exists for a low-cost 40 mm training cartridge for use in the M79/M203 grenade launchers and/or the XM174 automatic grenade launcher. The training cartridge must produce a color signal that is visible to the unaided eye under various terrain conditions at all usable ranges. These training cartridges are consumed in considerable quantities in training of troops which emphasizes the need for minimum cost.

The present invention evolved as part of an overall program to develop a new and improved cartridge that would satisfy the functional requirements of the current 40 mm, M407, practice cartridge at a substantially lower cost. The projectile of the M407 cartridge comprises a cavity filled with a finely-divided dye material and explosive means for disseminating the dye into the air at impact to produce a visible aerosol color signal. An object of the present invention was to substitute lower-cost non-explosive means for disseminating the dye material.

In accordance with the invention, a training cartridge projectile is provided, comprising: a housing having a prism-shaped axial recess, e.g. of hexagonal cross-section, closed at the rear and open at the front, in which a prism-shaped heavy piston of similar cross-section is slidably disposed; a cup-shaped ogive member of frangible material, e.g. plastic, having its open end attached to the open end of the housing to form a cavity therein and comprising an annular weakening groove; spring means resiliently interposed between the ogive member and the piston, and a mass of finely-divided color-producing material substantially filling the cavity, whereby on impact, the piston moves forwardly by inertia against the spring means, breaking the ogive member, and ejecting the color material into the air to form the desired aerosol color signal.

DETAILED DESCRIPTION OF A PREFERRED EMBODIMENT

Figure 2:
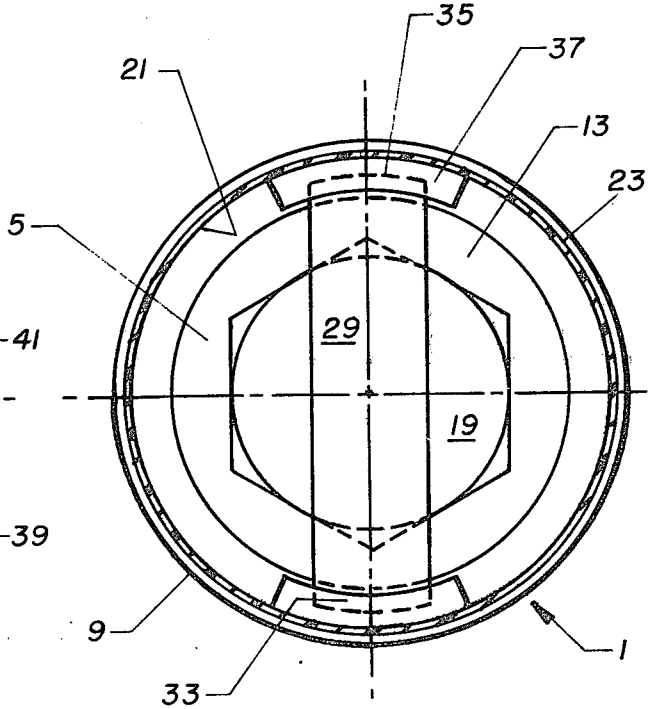
FIG. 2 is a transverse section view taken on line 2-2 of FIG. 1.
Figure 1:
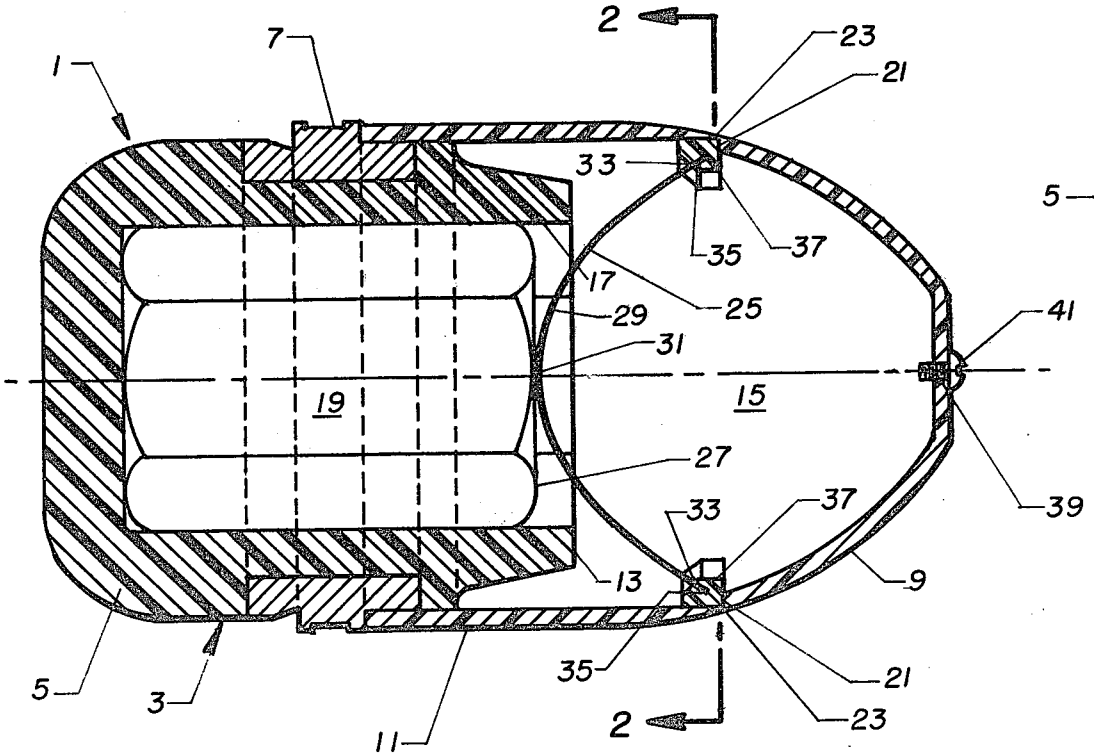
FIG. 1 is an axial section view of a training cartridge projectile incorporating the present invention.

FIGS. 1 and 2 illustrate an example of the invention incorporated in a projectile 1 adapted to be detachably mounted in the case of a training cartridge (not shown). Projectile 1 comprises a generally cylindrical housing 3 made up of a cup-shaped base member 5, preferably of molded plastic material, with an aluminum rotating band 7 imbedded as an insert in the periphery thereof, and a cup-shaped ogive member 9, also preferably of molded plastic material, having its open end 11 telescoped with the open end 13 of the base member 5 and attached to the rotating band 7, to form a dye cavity 15 therein.

A prism-shaped axial recess or cavity 17 of non-circular cross-section, preferably hexagonal, as shown in the drawing, is formed in the base member 5 during molding. A similarly-shaped heavy weight or piston 19, e.g. of steel, is slidably disposed in the recess 17, initially at the rear end of the recess, for forward movement into the dye cavity 15 on target impact.

The ogive member 9 is formed, intermediate its ends, with an interior annular groove 21, which leaves a thin annular weak region 23 in the wall of the ogive member and facilitates the opening of the dye cavity 15 on impact. Premature forward movement of the piston prior to impact is prevented by spring means 25 resiliently interposed between the ogive member 9 and the front end 27 of the piston 19. For example, spring means 25 may comprise a normally-straight leaf spring 29 having a central portion 31 engaging the piston 19 and two end portions 33 seated in notches 35 in a pair of plastic shoes which are disposed in opposite sides of groove 21.

After the parts have been assembled as shown in the drawing, the dye cavity 15 is substantially filled through a suitable opening, such as opening 39, closed by a screw plug 41, with a conventional signal dye material, such as a finely-divided mass of H1 VIZ dye.

For example, the projectile may be a 40 mm caliber one adapted to be fired in a 40 mm training cartridge through a rifled barrel, or other launch tube, to launch the projectile toward a desired target at ranges of several hundred meters. Preferably, the weights and shapes of the various parts of the projectile, and the cartridge propellant, are selected to mimic the performance of the standard M407 training cartridge.

In operation, when launched from a rifled barrel, the entire projectile 1 spins to assure dynamic stability in flight, and lands in the target area. When the nose of the projectile 1 impacts the target, or the ground, even in soft or vegetation-type terrain, the resulting projectile deceleration causes the heavy piston 19 to move forward into the dye cavity 15, distorting the leaf spring 29 and breaking off the front end of the ogive member 9 at the weak region 23, thus opening the dye cavity 15. The continued forward movement of the piston 19, aided by the flexing of the released leaf spring 29, disseminates the dye material into the air to form an aerosol signal cloud effectively marking the location of the projectile impact zone.

It will be understood that minor variations may be made without departing from the invention. For example, instead of the leaf spring 29 and shoes 37, a coil spring may be interposed between the piston 19 and the nose of the ogive member 9. Also, the invention may utilize finely-divided color-producing materials other than dyes, such as insoluble pigments.

What is claimed is:

1. A color dissimainting projectile for a training cartridge, comprising:

a generally cylindrical base member having a prism-shaped axial recess of non-circular cross-section, closed at the rear end and open at the front end;

a prism-shaped heavy piston of similar non-circular cross-section slidably disposed in said recess;

a cup-shaped ogive member of frangible material, closed at one end and open at the other end, having its open end attached to the open end of said base member to form a cavity therebetween, said ogive member having an annular interior groove forming an annular weak region therein;

spring means resiliently interposed between said ogive member and the front end of said piston, for preventing forward movement of said piston prior to impact; and a mass of finely-divided color-producing material substantially filling said cavity;

whereby, on target impact, said piston moves forward by inertia, engages said ogive member, breaks said weak region, and disseminates said material into the air, thus producing an easily-visible aerosol color signal in the region of impact.

2. A projectile as in claim 1, wherein:

said base member is primarily a molded plastic body having a recess of hexagonal cross-section;

said piston is a steel bar of hexagonal cross-section; and said ogive member is a molded plastic member.

3. A projectile as in claim 2, wherein:

said base member includes a peripheral aluminum rotating-band as an insert in said molded plastic body; and said ogive member is attached to said band.

4. A projectile as in claim 2, wherein:

said finely-divided color-producing material is a dye.

5. A projectile as in claim 1, wherein said spring means comprises:

a pair of arcuate shoes each having a corner disposed in said ogive member groove; and a leaf spring bent into an arcuate shape with two ends disposed in notches in said shoes and a central portion pressed against said piston end.

* * * * *